US010814667B2

(12) United States Patent
Triepel et al.

(10) Patent No.: US 10,814,667 B2
(45) Date of Patent: Oct. 27, 2020

(54) METHOD AND APPLICATION DEVICE FOR APPLYING A TRANSFER LAYER OF A FILM TO A SUBSTRATE

(71) Applicant: LEONHARD KURZ Stiftung & Co. KG, Furth (DE)

(72) Inventors: Michael Triepel, Furth (DE); Konstantin Kosalla, Nuremberg (DE); Klaus Pforte, Oberasbach (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 0 days.

(21) Appl. No.: 15/772,166

(22) PCT Filed: Nov. 2, 2016

(86) PCT No.: PCT/EP2016/076370
§ 371 (c)(1),
(2) Date: Apr. 30, 2018

(87) PCT Pub. No.: WO2017/076872
PCT Pub. Date: May 11, 2017

(65) Prior Publication Data

US 2018/0311997 A1 Nov. 1, 2018

(30) Foreign Application Priority Data

Nov. 3, 2015 (DE) ..... 10 2015 118 841
Mar. 31, 2016 (DE) ..... 10 2016 105 874

(51) Int. Cl.
*B44C 1/17* (2006.01)
*B42D 25/46* (2014.01)
(Continued)

(52) U.S. Cl.
CPC ..... *B44C 1/1729* (2013.01); *B41F 19/004* (2013.01); *B41F 19/007* (2013.01);
(Continued)

(58) Field of Classification Search
CPC .... B41F 19/004; B41F 19/007; B41F 19/008; B41F 19/02; B41F 19/062; B41J 11/002;
(Continued)

(56) References Cited

U.S. PATENT DOCUMENTS 4,919,994 A * 4/1990 Incremona ..... B44C 1/1733 156/234
5,207,855 A * 5/1993 Nyfeler ..... B41F 19/062 156/351
(Continued)

FOREIGN PATENT DOCUMENTS

CN 1565856 A 1/2005
CN 200981394 Y 11/2007
(Continued)

OTHER PUBLICATIONS

English translation of written opinion of PCT/EP2016/076370.*
(Continued)

*Primary Examiner* — Sonya M Sengupta
(74) *Attorney, Agent, or Firm* — Hoffmann & Baron, LLP

(57) ABSTRACT

A method for applying a transfer ply of a foil to a substrate, with the steps of:
a) regionally applying a radically curable adhesive to the transfer ply and/or the substrate by means of an inkjet printhead;
b) precuring the adhesive by UV irradiation;
c) applying the transfer ply to the substrate by means of a stamping apparatus;
d) fully curing the adhesive by UV irradiation;
e) peeling a carrier ply of the foil, to leave at least one first subregion of the transfer ply on an application region of the substrate, and at least one second subregion of the transfer ply on the carrier ply;
f) winding up or recoiling the carrier ply with the remaining second subregion of the transfer ply;
(Continued)

g) applying at least one further subregion of the transfer ply remaining on the carrier ply to the substrate by at least once repeating steps a) to f).

48 Claims, 3 Drawing Sheets

(51) Int. Cl.

| | |
|---|---|
| ***B42D 25/47*** | (2014.01) |
| ***B42D 25/455*** | (2014.01) |
| ***B42D 25/48*** | (2014.01) |
| ***B42D 25/29*** | (2014.01) |
| ***B42F 19/00*** | (2006.01) |
| ***B41F 19/02*** | (2006.01) |
| ***B42D 25/328*** | (2014.01) |
| ***B42D 25/333*** | (2014.01) |
| ***B42D 25/373*** | (2014.01) |
| ***B42D 25/405*** | (2014.01) |
| ***B41F 19/06*** | (2006.01) |
| ***B41J 2/005*** | (2006.01) |
| ***B41J 11/00*** | (2006.01) |
| ***B41M 3/00*** | (2006.01) |
| ***B41F 19/00*** | (2006.01) |

(52) U.S. Cl.
CPC ..... *B41F 19/008* (2013.01); *B41F 19/02* (2013.01); *B41F 19/062* (2013.01); *B41J 2/0057* (2013.01); *B41J 11/002* (2013.01); *B42D 25/29* (2014.10); *B42D 25/328* (2014.10); *B42D 25/333* (2014.10); *B42D 25/373* (2014.10); *B42D 25/405* (2014.10); *B42D 25/455* (2014.10); *B42D 25/46* (2014.10); *B42D 25/47* (2014.10); *B42D 25/48* (2014.10); *B44C 1/1733* (2013.01); *B41M 3/006* (2013.01)

(58) Field of Classification Search
CPC ..... B41J 2/0057; B41M 3/006; B42D 25/29; B42D 25/328; B42D 25/333; B42D 25/373; B42D 25/405; B42D 25/455; B42D 25/46; B42D 25/47; B42D 25/48; B44C 1/1729; B44C 1/1733
USPC ..... 156/235, 247, 249
See application file for complete search history.

(56) References Cited

U.S. PATENT DOCUMENTS

| | | | | |
|---|---|---|---|---|
| 9,266,361 | B2 | 2/2016 | Plaia et al. | |
| 9,511,619 | B2 | 12/2016 | Wening et al. | |
| 2003/0022403 | A1 | 1/2003 | Shimoda et al. | |
| 2005/0167035 | A1 | 8/2005 | Laskey et al. | |
| 2010/0140822 | A1 | 6/2010 | Drinic et al. | |
| 2010/0212821 | A1 | 8/2010 | Grinberg et al. | |
| 2014/0174306 | A1* | 6/2014 | Wening | B32B 37/203 101/25 |
| 2015/0014936 | A1 | 1/2015 | Murota | |
| 2015/0298494 | A1 | 10/2015 | Ohnishi | |
| 2015/0343761 | A1 | 12/2015 | Roeder et al. | |
| 2018/0072045 | A1* | 3/2018 | Kosalla | B41F 19/004 |

FOREIGN PATENT DOCUMENTS

| | | | |
|---|---|---|---|
| CN | 101711202 | A | 5/2010 |
| CN | 201559348 | U | 8/2010 |
| CN | 103635332 | A | 3/2014 |
| CN | 104582964 | A | 4/2015 |
| CN | 104781075 | A | 7/2015 |
| DE | 19858694 | | 6/2000 |
| DE | 102005029640 | | 12/2006 |
| DE | 102009002810 | | 11/2009 |
| DE | 102012223700 | | 6/2014 |
| EP | 0433575 | | 6/1991 |
| EP | 0498040 | | 8/1992 |
| EP | 2172347 | | 4/2010 |
| GB | 2259888 | | 3/1993 |
| JP | 2009226880 | | 10/2009 |
| TW | 586231 | | 5/2004 |
| WO | WO2012159871 | | 11/2012 |
| WO | WO2014005823 | | 1/2014 |
| WO | WO2014076074 | | 5/2014 |
| WO | WO2014096074 | | 6/2014 |

OTHER PUBLICATIONS

ISR of PCT/EP2016/076370.*
English translation of EP2172347.*
English translation of WO2014005823.*
English translation of EP0498040.*
Office Action from corresponding Taiwanese Application No. 105135267, pp. 1-41, dated May 8, 2020.

* cited by examiner

METHOD AND APPLICATION DEVICE FOR APPLYING A TRANSFER LAYER OF A FILM TO A SUBSTRATE

This application claims priority based on an International Application filed under the Patent Cooperation Treaty, PCT/EP2016/076370, filed Nov. 2, 2016, which claims priority to DE102015118841.4, filed Nov. 3, 2015 and DE102016105874.2, filed Mar. 31, 2016.

BACKGROUND OF THE INVENTION

The invention relates to a method and to an application apparatus for applying a transfer ply of a foil to a substrate.

In the application of a transfer ply of a foil from a carrier ply of the foil to a substrate, such as to a security document or to packaging, for example, it is generally only subregions of the transfer ply that are transferred to the substrate. The remnants of the transfer ply that are left on the carrier ply of the foil are usually discarded. Because the production of the transfer ply is often very involved and expensive particularly for foils for the decoration of security documents, the significant quantity of unused transfer ply represents a substantial cost factor.

In order to solve this problem it is known practice, after a first run of applying a carrier ply with continuous design, to use the wound-up roll, comprising the detached carrier ply of the foil and the remaining regions of the transfer ply, as a source once again for a further application process, with the second application taking place in those regions of the transfer ply still remaining on the carrier ply of the foil, between the regions of the first application that were applied to the substrate. The regions of the transfer ply detached from the carrier ply of the foil (gaps) are recognized via corresponding sensors, which then control the application, more particularly second application, and any further application.

Methods of this kind use firmly prescribed stamping layouts either in the form of a hot stamping die or in the form of a firmly defined adhesive layout employing cold adhesives. Flexible variation of the adhesive layout and hence of the design of the stamping is therefore not possible.

Furthermore, methods of this kind are generally applicable only to continuous designs or are at least problematic in the context of applying transfer plies having individual-image designs.

SUMMARY OF THE INVENTION

It is an object of the present invention, therefore, to provide a method and also an application apparatus for applying a transfer ply of a foil that allow the transfer ply to be applied both flexibly and in a manner that is particularly economical with the material.

A method of this kind for applying a transfer ply of a foil to a substrate comprises the steps of:

a) regionally applying a radically curable adhesive to the transfer ply and/or the substrate by means of an inkjet printhead;

b) precuring the adhesive by UV irradiation;

c) applying the transfer ply to the substrate by means of a stamping apparatus;

d) fully curing the adhesive by UV irradiation;

e) peeling a carrier ply of the foil from the transfer ply, to leave at least one first subregion of the transfer ply on an application region of the substrate, and at least one second subregion of the transfer ply on the carrier ply;

f) winding up or recoiling the carrier ply with the remaining second subregion of the transfer ply;

g) applying at least one further subregion of the transfer ply remaining on the carrier ply to the substrate by at least once repeating steps a) to f).

An alternative method for applying a transfer ply of a foil to a substrate comprises the steps of:

a) regionally a thermoplastic toner to at least one subregion of the substrate and/or to at least one subregion of a transfer ply of a further foil;

b) applying the transfer ply to the substrate by means of a stamping apparatus;

c) causing an applied pressure and heat to act on the transfer ply and/or the substrate;

d) peeling a carrier ply of the foil, to leave at least one first subregion of the transfer ply on an application region of the substrate, and at least one second subregion of the transfer ply on the carrier ply;

e) winding up or recoiling the carrier ply with the remaining second subregion of the transfer ply;

f) applying at least one further subregion of the transfer ply remaining on the carrier ply to the substrate by at least once repeating steps a) to e).

An application apparatus suitable for implementing such a method is one which comprises the following components:

a supply roller for providing the foil;

an inkjet printhead for regionally applying a radically curable adhesive to the transfer ply and/or the substrate;

a first UV light source, disposed downstream of the inkjet printhead in the conveying direction of the foil, for precuring the adhesive by UV irradiation;

a roll arrangement, disposed downstream of the first UV light source in the conveying direction of the foil, for applying the transfer ply to the substrate;

a second UV light source, disposed downstream of the roll arrangement in the conveying direction of the foil, for fully curing the adhesive by UV irradiation;

a peeling unit, disposed downstream of the second UV light source in the conveying direction of the foil, for peeling a carrier ply of the foil, with at least a first subregion of the transfer ply being left on an application region of the substrate, and at least a second subregion of the transfer ply being left on the carrier ply;

at least one first sensor for detecting a positioning feature on the foil and/or on a foil transport apparatus.

An alternative application apparatus comprises:

a supply roller for providing the foil;

an inkjet printhead, disposed downstream of the supply roller in the conveying direction of the foil, for applying a radically curable adhesive, and/or a printing apparatus for applying a thermoplastic toner to at least one subregion of the transfer ply;

at least one roll arrangement, disposed downstream of the inkjet printhead and/or of the printing apparatus in the conveying direction of the foil, for applying the at least one subregion of the transfer ply provided with adhesive and/or toner to the substrate;

a peeling unit, disposed downstream of the roll arrangement in the conveying direction of the foil, for peeling a carrier ply of the foil from the at least one subregion of the transfer ply, where at least one first subregion of the transfer ply is left on an application region of the substrate, and at least one second subregion of the transfer ply is left on the carrier ply;

at least one first sensor for detecting a positioning feature on the foil and/or on a foil transport apparatus.

In the context both of the method and of the application apparatus, the use of UV-curing adhesives and thermoplastic toners may also be combined arbitrarily.

By means of the method described and by means of the application apparatus described it is possible on the one hand to flexibly configure the stamping design by means of the digital inkjet printing method used.

On the other hand, if the foil layout allows after the first application, the foil can be used more than once, and regions of the transfer ply that have not yet been transferred can be transferred in further application steps to the same or to a different substrate.

Accordingly it is possible to apply transfer ply regions of any desired shape and, at the same time, to optimize the utilization of material of the transfer ply, so that as little material as possible has to be discarded.

The substrate may be opaque, semi-transparent or transparent. As a result it is possible to achieve particular visual appearances and effects in combination with the applied transfer ply of the foil, especially when viewed in reflected light, when viewed in transmitted light, or with illumination, illumination from behind, and/or transillumination.

The transfer ply of the foil may have diverse decorations or motifs. These decorations or motifs, for example, may be in a single color and/or may have been given a multicolor continuous pattern and/or multicolor registered individual-image patterns. An individual-image pattern of this kind may in particular be positioned in-register on the substrate.

The decorations or motifs may at least in regions have opaque, semi-transparent or transparent regions, which in each case may also have been provided with dyes and/or color pigments and/or metallic pigments and/or optically variable effect pigments.

The decorations or motifs may, furthermore, have been provided at least in regions with a mirror like reflection layer, applied in particular by vapor deposition and, in particular, comprising metal such as, for example, aluminum or copper or chromium, or alloys thereof, in order to produce particular optical effects. It is preferred in this case if the reflection layer is applied by sputtering, vapor application or vapor deposition. By these means it is possible to obtain reflection layers having high quality and a particularly constant layer thickness. In this case the reflection layer is preferably applied partially. That can be done, for example, by using a mask or a partial coating layer, which is removable and has been applied beforehand, during the application of the reflection layer. Alternatively it is also possible for the reflection layer first to be applied over the full area and subsequently patterned. This patterning may be accomplished, for example, by etching. The etching agent is selected in line with the composition of the reflection layer and is contacted with the reflection layer only in those regions thereof that are to be removed. This can be achieved, for example, by partially masking the reflection layer with an etch resist, or else by partial print application of the etching agent.

The decorations or motifs may, furthermore, have been provided at least regionally a replication layer having optical-effect relief structures—for example, diffractive and/or refractive relief structures. The layer thickness of the replicating layer is in the range from 50 nm to 50 μm, preferably in the range from 200 nm to 1 μm. The relief structures in particular may comprise a preferably linear or crossed sinusoidal diffraction grating, a linear or crossed single-stage or multistage rectangular grating, a zero-order diffraction structure, an asymmetric relief structure, a blaze grating, a preferably isotropic or anisotropic, matt structure, or a light-diffracting and/or light-refracting and/or light-focusing nanostructure or microstructure, a binary or continuous Fresnel lens, a binary or continuous Fresnel free-form surface, a microprism structure, or a combination structure thereof.

Usefully here a layer thickness of the carrier foil is from 6 μm to 100 μm, preferably from 12 μm to 50 μm.

It is further preferred if the foil comprises a protective layer, composed in particular of a UV-curing varnish, of PVC, polyester or an acrylate, this layer being disposed between the carrier ply and the transfer ply. In contrast to the carrier ply, a protective layer of this kind preferably remains on the transfer ply when the latter is applied to the substrate, and there forms its outer surface. The protective layer is thus able to protect the sensitive other layers of the transfer ply from environmental effects, soiling, scratches, and the like. This additional protective layer may also have been provided with a surface relief. By that means it is possible to combine additional interesting optical and/or functional effects, such as dynamic matt stretches or surfaces that look tactile, for example, with a decorative color, for example. A combined effect of this kind, uniting a surface relief with a printing element, enhances the visual attractiveness and/or the resulting functionality. It is useful here if a layer thickness of the protective layer is from 1 μm to 20 μm, preferably from 3 μm to 10 μm. A surface relief of this kind may be incorporated into the protective layer in such a way, for example, that a negative of this surface relief is made in the surface of a roll, more particularly by engraving or etching, or is made by means of insert elements. During application, the protective layer of the foil, bearing against the roll, is pressed against this mold half and the surface relief is reproduced correspondingly in the protective layer.

In a further embodiment, the foil has a detachment layer, composed in particular of a wax layer and/or of a strongly filming acrylate, which is disposed between the carrier ply and the protective layer. A detachment layer of this kind allows the transfer ply to be detached easily and without damage from the carrier ply when the transfer ply is applied to the substrate. In this case usefully a layer thickness of the detachment layer is from 5 nm to 1 μm, preferably from 10 nm to 1 μm.

Furthermore, the foil preferably has an adhesion promoter layer, which is disposed on that side of the reflection layer that faces away from the carrier ply. This adhesion promoter layer may comprise a hotmelt adhesive, a cold adhesive, an optically or thermally activatable adhesive, a UV-activatable adhesive, or the like, which allows effective adhesion of the adhesive to the foil. In this case, usefully, a layer thickness of the adhesive layer is from 50 nm to 50 μm, preferably from 0.5 μm to 10 μm.

In one preferred embodiment, the decorations or motifs are applied at least in regions by printing, more particularly by screen printing, gravure printing, inkjet, engraved steel gravure printing (intaglio printing) or offset printing. The printing methods stated may also be combined with one another in order, for example, to generate decorations or motifs having a plurality of print plies and complex optical effects. Alternatively or additionally, the decorations or motifs may be applied at least regionally by surface coating, casting, dipping and/or vapor application. Especially thin-film layer systems consisting of a plurality of layers.

Application of the adhesive regionally, or in regions, means here that in a first region of the transfer ply and/or of the substrate, the adhesive is applied, whereas in a second region of the transfer ply and/or the substrate, no adhesive is applied.

Preferably for this purpose, the inkjet printhead is driven by provision of a digital data set which defines those regions in which and/or that application rate with which the adhesive is to be applied.

The precuring of the radically curable adhesive here improves the quality of application. In particular it increases the viscosity of the adhesive before the transfer ply is pressed, in the roll arrangement, onto the substrate. This prevents running or excessive oozing of the applied pixels of adhesive during transfer, hence achieving particularly sharply defined application of the transfer ply to the substrate and particularly high surface quality on the part of the layers transferred. Minor oozing of the pixels of adhesive is entirely desirable here, in order to bring them closer to, and into unison with, directly adjacent adhesive pixels. This may be advantageous in order to avoid a pixelated appearance in the case, for example, of continuous areas and/or at motif edges, in other words to avoid individual pixels disrupting the visual appearance. The oozing here may occur only in so far as the desired resolution is not too greatly diminished.

The particularly sharply defined application of the transfer ply within the method described also ensures that those regions of the transfer ply that remain on the carrier ply after application are also well and sharply defined, thus producing virtually no transfer ply regions that cannot be utilized for further application.

As compared with cationically curing adhesives, moreover, the use of radically curable adhesives affords the advantage of particularly rapid full curing, something actually enabled by the precuring of the adhesive prior to foil application. Furthermore, in the case of full radical curing, in contrast to cationic systems, no acids are formed, and so there are no restrictions on the substrate that can be used, in terms of acid compatibility.

It is possible here to use not only foils with a continuous design but also foils with individual-image designs, and in each case the stamping may take place in-register. The foil may therefore be positioned in such a way that, in particular, an individual image is transferred onto the substrate precisely at the prescribed site. For this purpose it is necessary equally for the UV adhesive to be printed onto the foil or substrate at the correct position of the foil or substrate, respectively, in particular such that it is in register with the individual image, to then allow the individual image to be transferred in-register to the substrate by means of the adhesive.

This is possible in particular because within the method described it is possible to monitor three criteria, namely the position of the substrate, the position of the foil, and the position of the print of adhesive on the foil or onto the substrate.

For this purpose it is advantageous if by means of at least one first sensor, a positioning feature on the foil and/or a foil transport apparatus is detected and at least one first positional datum relating to the foil is generated.

The apparatus can be driven on the basis of this positional datum, in such a way as to ensure the desired relative positioning between foil, substrate, and adhesive.

It is advantageous here if the first positional datum comprises a siting and/or extent of the transfer ply remaining on the carrier ply.

On the basis of this positional datum it is possible to ensure that in the case of multiple application runs, the desired design is transferred completely and with optimum utilization of material.

Further it is preferred if by means of at least one second sensor, a positioning feature on the substrate and/or a substrate transport apparatus is detected and at least one second positional datum relating to the substrate is generated.

This positional datum can be utilized on its own or else in combination with further positional data in order to control the apparatus and/or foil application. Generating the second positional datum is especially advantageous when the foil is to be applied with register retention with respect to other design elements or functional elements of the substrate.

It is advantageous here if the positioning feature on the substrate and/or the positioning feature on the foil is or comprises a registration mark provided during production of the substrate and/or a registration mark applied by means of the inkjet printhead and/or a design feature of the substrate and/or foil and/or a sheet edge of the substrate and/or foil.

The shape and design of the positioning feature on the foil or on the substrate is therefore substantially freely selectable, meaning that the method described does not necessitate any restrictions at all on design.

It is further advantageous if by means of at least one third sensor, a positioning feature on the foil and/or a foil transport apparatus in the region of the inkjet printhead is detected and at least one third positional datum relating to the foil is generated.

By this means it is possible to set the relative position between inkjet printhead and foil with particular accuracy, since in this way the precise siting of the foil is detected in the direct vicinity of the inkjet printhead. This ensures particularly precise application of adhesive.

It is useful, furthermore, if at least one of the first, second, third positional data is generated and/or corrected and/or verified on the basis of control commands transmitted beforehand to the substrate transport apparatus and/or the foil transport apparatus and/or the inkjet printhead.

In this way it is possible to determine the position of foil and/or of substrate, starting from a known initial position and from the substrate or foil transport operations conducted up until that time. This information may be utilized on the one hand in order to do without sensors, and on the other hand it is possible in this way to generate an additional datum that can be used for monitoring and/or for calibrating the sensor data.

It is advantageous here if the at least one subregion and/or the at least one further subregion are brought into a defined relative position to the inkjet printhead and/or to the application region of the substrate, as a function of at least one of the positional data.

In other words, it is possible in this way, on the basis of the positional data, to ensure the desired in-register transfer of the subregion of the transfer ply to the application region of the substrate.

In-register status or else register accuracy refers to a siting accuracy of two or more elements and/or regions and/or layers relative to one another. The register accuracy here is to range within a prescribed tolerance, and is to be as minimal as possible. At the same time, the register accuracy of two or more elements and/or layers to one another is an important feature for increasing anti-counterfeit security. Site-accurate positioning may be accomplished in particular by means of optically detectable registration or register marks. These registration or register marks may either represent specific separate elements or regions or layers, or may themselves be part of the elements or regions or layers to be positioned.

All in all there are up to three input variables—i.e., the measurement data from the at least one first to third sensors—and three controlled variables, in particular the rate of advance of foil and substrate, and the positioning of the inkjet printhead for the control or regulation of the application apparatus. The result of this is a plurality of possibilities for the implementation of the control or regulation logic.

On the one hand it is possible that the foil transport apparatus is controlled or regulated as a function of the at least one second positional datum.

It is useful here if the substrate transport apparatus and/or the inkjet printhead are controlled and/or regulated as a function of a control datum for the foil transport apparatus and of the first and/or third positional datum.

In this case, therefore, it is the second positional datum, in other words the datum relating to the substrate, that serves as master input variable, in dependence on which control takes place. This may again be implemented in a variety of ways.

First of all it is possible to implement control with the print mark sensor of the substrate, i.e., the second sensor, according to which the rate of advance of the foil and also the inkjet printhead are controlled.

Alternatively, the print mark sensor of the substrate may be used for control and, in dependence thereon, there may be regulation of the foil and subsequent regulation and/or driving of the inkjet printhead by the foil mark, in other words the measurement values from the first sensor.

It is also possible to do without regulation of foil transport. In that case there is only regulation of the printing by the foil mark, i.e., the first sensor, or else by the print mark of the substrate, i.e., the second sensor.

Furthermore, it is also possible for control with the print mark sensor of the substrate to be implemented with regulation of the foil on the basis of the data from the second sensor, in which case there is no need for regulation of the print.

Alternatively it is possible that the substrate transport apparatus is also controlled or regulated as a function of the at least one first positional datum relating to the foil.

In this case it is useful if the foil transport apparatus and/or the inkjet printhead are controlled and/or regulated as a function of a control datum for the substrate transport apparatus and of the second and/or third positional datum.

In this case, then, it is the first positional datum, in other words the datum relating to the foil, that serves as the master input variable, in dependence on which control takes place. This may likewise in turn be implemented in a variety of ways.

Here as well it is possible to implement control with the print mark sensor of the foil, i.e., the first sensor, according to which the rate of advance of the substrate and also the inkjet printhead are controlled.

Alternatively, the print mark sensor of the foil may be used for control and, in dependence thereon, there may be regulation of the rate of substrate advance and subsequent regulation and/or driving of the inkjet printhead by the substrate mark, in other words the measurement values from the second sensor.

It is also possible to do without regulation of substrate transport. In that case there is only regulation of the printing by the substrate, i.e., the second sensor, or else by the print mark of the foil, i.e., the first sensor.

Furthermore, it is also possible for control with the print mark sensor of the foil to be implemented with regulation of the substrate on the basis of the data from the first sensor, in which case there is no need for regulation of the print.

It is further preferred if the transport means sets extension of the foil to a value of 1‰ to 6‰, preferably of 3‰.

A certain basic extension of the foil is necessary fundamentally in order to ensure precise guidance. Variations in the extension can be utilized in order to monitor foil transport and to bring about precise registration between foil, printhead, and substrate.

In this case it is useful if to set the defined relative position between foil and substrate and/or inkjet printhead, the transport means varies the extension of the foil on the basis of at least one of the positional data.

Preferably the adhesive is applied using an inkjet printhead having a resolution of 300 to 1200 applicator nozzles per inch (npi). This allows high-resolution application of the adhesive, meaning that even fine foil structures can be transferred with sharp definition. In general here the resolution of the printhead corresponds to the resolution achieved in terms of the drops of adhesive on the transfer ply in dpi (dots per inch).

It is further preferred if the adhesive is applied using an inkjet printhead having a nozzle spacing of 30 μm to 80 μm.

The small nozzle spacing—in particular transversely to the direction of printing—ensures that the drops of adhesive transferred are sufficiently close to one another on the transfer ply or else, where appropriate, overlap, so that effective adhesion is obtained over the whole of the printed surface.

It is further preferred if the adhesive is applied with a coat weight of 1.6 $g/m^2$ to 7.8 $g/m^2$ and/or with a layer thickness of 1.6 μm to 7.8 μm. Within this range, which guarantees effective adhesion, it is possible to vary the application rate and/or layer thickness of the adhesive as a function of the substrate used, in particular as a function of the absorbency of that substrate, in order to optimize further the application outcome.

It is useful here if the inkjet printhead provides drops of adhesive having a frequency of 6 kHz to 110 kHz. At customary conveying rates of the foil to be printed of 10 m/min to 30 m/min, it is thus possible in conveying direction to achieve the desired resolution of 300 dpi to 1200 dpi.

Preferably the inkjet printhead provides drops of adhesive having a volume of 2 pl to 50 pl with a tolerance of not more than ±6%. Hence, with the described application resolutions and application speeds, the necessary quantity of adhesive is applied uniformly.

It is preferred here if the inkjet printhead provides drops of adhesive having a flight velocity of 5 m/s to 10 m/s with a tolerance of not more than ±15%. As a result the diversion of the drops of adhesive, particularly by drafts of air, is minimized during transfer from the printhead, and so the drops of adhesive land in the desired defined disposition.

Further it is useful if the adhesive is applied with an application temperature of 40° C. to 45° C. and/or with a viscosity of 5 mPas to 20 mPas, preferably of 7 mPas to 15 mPas. Temperature control of the printhead here ensures that the adhesive possesses the desired viscosity. Dependent on the viscosity, in turn, are the pixel size and pixel shape of the adhesive applied to the transfer ply—with the values specified, optimum printability of the adhesive is ensured.

As soon as the adhesive leaves the printhead and comes into contact with ambient air and/or with the transfer ply, cooling takes place, and this raises the viscosity of the adhesive. The effect of this is to counteract running or spreading of the drops of adhesive transferred.

It is further advantageous if a spacing between inkjet printhead and substrate during application of the adhesive does not exceed 1 mm.

This as well reduces the effect of drafts of air on the adhesive.

Preferably here a relative velocity between inkjet printhead and transfer ply and/or substrate during application of the adhesive is about 10 m/min to 100 m/min, in particular about 10 m/min to 75 m/min.

With these velocities, especially in combination with the parameters specified above, the desired resolution of the adhesive printed onto the transfer ply is obtained.

Preferably in this case an adhesive is used with the following composition (percentages denote percent by volume):

| | |
|---|---|
| 2-phenoxyethyl acrylate | 10% to 60%, preferably 25% to 50%; |
| 4-(1-oxo-2-propenyl)morpholine | 5% to 40%, preferably 10% to 25%; |
| exo-1,7,7-trimethylbicyclo[2.2.1]hept-2-yl acrylate | 10% to 40%, preferably 20% to 25%; |
| 2,4,6-trimethylbenzoyldiphenyl phosphine oxide | 5% to 35%, preferably 10% to 25%; |
| dipropylene glycol diacrylate | 1% to 20%, preferably 3% to 10%; |
| urethane acrylate oligomer | 1% to 20%, preferably 1% to 10%; |
| carbon black pigment | 0.01%-10%, preferably 0.1% to 0.5%. |

A formulation of this kind guarantees the desired properties, particularly the rapid full curing and a viscosity which allows ready printability in conjunction with stable and sharply defined application.

It is useful here if an adhesive having a density of 1 g/ml to 1.5 g/ml, preferably of 1.0 g/ml to 1.1 g/ml, is used.

Preferably the adhesive is precured 0.02 s to 0.025 s after the adhesive has been applied. By this means the adhesive is fixed on the transfer ply or on the substrate, respectively, very quickly after printing, by virtue of the precuring, and so running or spreading of the drops of adhesive is largely avoided and the high print resolution is very substantially retained.

It is useful here if the adhesive is precured with UV light, at least 90% of whose energy is irradiated in the wavelength range between 380 nm and 420 nm. At these wavelengths, particularly in the case of the adhesive formulations outlined above, the full radical curing is set reliably in train.

It is further advantageous if the adhesive is precured with a gross irradiation power of 2 $W/cm^2$ to 5 $W/cm^2$ and/or in particular with a net irradiation power of 0.7 $W/cm^2$ to 2 $W/cm^2$ un and/or with an energy input into the adhesive of 8 $mJ/cm^2$ to 112 $mJ/cm^2$. This means that the adhesive experiences the desired increase in viscosity, while yet not being completely cured, so that the necessary adhesion of the adhesive is retained during application of the transfer ply to the substrate.

Preferably here the adhesive is precured with an exposure time of 0.02 s to 0.056 s. With the aforementioned transport speeds of the substrate, and the stated irradiation powers, the required energy input for the precuring is ensured in this way.

It is useful here if when the adhesive is precured its viscosity increases to 50 mPas to 200 mPas. An increase in viscosity in this way guarantees that the drops of adhesive do not suffer oozing when the transfer ply is applied to the substrate, hence allowing the transfer ply to be transferred to the substrate substantially with the resolution achieved during printing of the adhesive.

The at least one subregion of the transfer ply is applied to the substrate here preferably between a press roll and an impression roll. In this way, a linear pressure constant over the entire width of the substrate, and hence a uniform and high-quality application of the transfer ply, are achieved.

It is useful here if the at least one subregion of the transfer ply provided with adhesive is applied to the substrate with an applied pressure of 10 N to 80 N. Within this range, the applied pressure can be varied in order to adapt the method to the nature of the substrate and to prevent instances of substrate damage or deformation.

Application of the transfer ply may take place to various substrates. For example, the transfer ply can be applied to paper substrates with coated and uncoated surfaces, natural papers, plastics (PE, PP, PET), and labelled materials, and also to glass or ceramic. In the case of substrates of plastic, glass or ceramic, pretreatment may be useful in order to improve the adhesion of the adhesive to the substrate 3, by means of corona treatment, plasma treatment or flaming, for example). The application outcome is better here with smoother substrate surfaces.

In one advantageous embodiment it is possible to enable foil application to a substrate in the form of a three-dimensional article, more particularly a cylindrical, oval, rectangular or flat article, especially on rotary indexing machines or linear indexing machines, where foil application is only part of the operations performed on the substrate. In machines of this kind, for example, before and/or after foil application, there are also any of a wide variety of printing and/or coating procedures. During foil application, in particular, the substrate is held either in such a way as to be rotatable about an axis of rotation, or in such a way as to be firmly fixed by a holding means, and the transfer ply of the foil is subsequently pressed onto the substrate by a pressing means, with the adhesive being cured at the same time.

It is preferred here if the pressing means is transparent, at least in subregions, to UV radiation. This allows the pressing means to be disposed between a UV radiation source, which generates the UV radiation, and the holding means. The regions in which the pressing layer is transparent may be guided by the regions at which the holding means is transparent. Alternatively, the pressing layer may also be entirely transparent, whereas the holding means is transparent only in places.

The pressing means and/or the pressing layer is preferably transparent or translucent for UV radiation in the wavelength range from 250 nm to 420 nm, preferably in the range from 380 nm to 420 nm, more preferably 380 nm to 400 nm. The transparency or translucency here is to be, in particular, 30% to 100%, preferably 40% to 100%. The transparency or translucency is dependent here on the thickness of the pressing layer. A lower transparency or translucency may be compensated by higher UV intensity.

The UV radiation source, for example, may be disposed within a cylinder of the pressing means. For this purpose the cylinder is configured at least in places as a hollow cylinder. The material of the cylinder here is selected such that the wavelengths of the UV radiation which are needed for the curing of the adhesive can be transmitted through the cylinder. The cylinder may be completely transparent for the UV radiation; alternatively, transparent windows may also be provided in the cylinder, so that UV radiation emerges from the cylinder only when the UV radiation is specifically needed for the curing of the adhesive.

In particular, the region of the substrate which is to be exposed using UV radiation may be adjusted so that, when the transfer foil is pressed onto the adhesive, the curing of the UV adhesive has advanced to an extent such that the transfer ply of the foil adheres to the substrate and can be parted from the carrier foil. Depending on the adhesive used and on the intensity of the UV radiation, it may for this purpose be necessary to expose the adhesive on the substrate even ahead of the contact line between the substrate and foil.

Adjusting the region to be exposed may be accomplished, for example, by (optionally adjustable or exchangeable) screens between UV radiation source and substrate. One or more screens may also be mounted directly on the pressing means. Adjustment may also be accomplished by adjusting the divergence of the UV radiation emitted by the UV radiation source.

In a further preferred embodiment of the method, the pressing apparatus additionally has a flexible pressing layer on the holding means. In this way it is possible to compensate irregularities in the three-dimensional substrate, in the foil and/or in the mechanical construction. The flexible pressing layer may consist of silicone, for example.

The pressing means and/or the pressing layer is preferably made of silicone and has a thickness, in the region through which UV radiation is to pass, in the range from 1 mm to 20 mm, preferably from 3 mm to 10 mm. The silicone preferably has a hardness of 20° Shore A to 70° Shore A, preferably 20° Shore A to 50° Shore A. The silicone may be a hot vulcanizate or cold vulcanizate, preferably a hot vulcanizate.

It is also possible to construct the pressing means and/or the pressing layer from a plurality of silicone layers. In that case the individual silicone layers may each have different hardnesses. For example, a first, inside layer may have a hardness of 10° Shore A to 50° Shore A, preferably 15° Shore A to 35° Shore A, and an outer layer may have a hardness of 20° Shore A to 70° Shore A, preferably of 20° Shore A to 50° Shore A.

The pressing means may be joined to the pressing layer, in particular, in a force-fitting and/or form-fitting manner. This allows a particularly robust join to be achieved.

The shape of the pressing layer may be flat or three-dimensionally shaped (three-dimensionally domed or bowed contour with a smooth or structured/textured surface). Flat pressing layers are suitable particularly for the application of the foil to cylindrical geometries, and three-dimensionally shaped pressing layers are suitable particularly for noncircular, oval and angular geometries. A structured and/or textured surface to the pressing layer may also be advantageous for the purpose of transmitting this structure and/or texture to the surface of the substrate in a superimposing way when the transfer ply of the foil is transferred. The structure and/or texture here may be a continuous pattern or continuous motif or else an individual pattern and/or motif, or a combination thereof.

In series of trials in particular, it has emerged that the surface of a silicone surface of the pressing layer may be adhesive for the foil to be processed. In that case the surface roughness (mean roughness value) of an adhesive surface of this kind is, from experience, below about 0.5 μm, more particularly between 0.06 μm and 0.5 μm, preferably between about 0.1 μm and 0.5 μm. With an adhesive surface of this kind it is advantageous if there is an interlayer, made in particular of PET, between pressing layer and foil. The interlayer reduces the adhesiveness of the pressing layer and considerably facilitates the processing of the foil, since the foil no longer remains disruptively adhering on the surface of the pressing layer. The thickness of the interlayer increases the effective hardness of the silicone die compensating effect. A number of exemplary embodiments are given below:

5 mm pressing layer of silicone (49° Shore A) with 15 μm interlayer (PET foil) produces 73° Shore A (corresponding to 49% increase).

5 mm pressing layer of silicone (49° Shore A) with 50 μm interlayer (PET foil) produces 85° Shore A (corresponding to 70% increase).

10 mm pressing layer of silicone (47° Shore A) with 15 μm interlayer (PET foil) produces 71° Shore A (corresponding to 51% increase).

10 mm pressing layer of silicone (47° Shore A) with 50 μm interlayer (PET foil) produces 78° Shore A (corresponding to 59% increase).

With regard to these figures it should be noted that on the basis of the definition of the measurement conditions for the Shore A measurement method, it is not actually permissible any longer to measure the sandwich composed of pressing layer and interlayer. The Shore A measurement method measures a depth of penetration of a test body between 0 mm and 2.5 mm and prescribes a minimum specimen thickness of 6 mm. As a result of the interlayer in conjunction with the Shore A measurement method, therefore, the apparent hardness is greater than the hardness actually present. The measurement value cannot be used to draw conclusions about the actual/effective hardness. All that may be stated is that the effective hardness of the sandwich is greater than the hardness of the silicone die, and the foil dominates and defines the overall hardness of the sandwich, independently of the thickness of the silicone layer.

The pressing layer is preferably provided with a non-adhesive surface, and so it is possible to omit the use of an interlayer. In that case the overall arrangement is softer, and so a smaller pressing force is sufficient to press the substrate onto the pressing layer. The surface roughness (mean roughness value) of a non-adhesive surface of this kind, from experience, is above about 0.5 μm, more particularly between 0.5 μm and 5 μm, preferably between about 0.6 μm and 4 μm, more preferably between about 0.8 μm and 3 μm.

The pressing means or pressing layer ensures the reliable and even unrolling of the three-dimensional substrate under defined conditions, and at the same time evens out dimensional and motion tolerances thereof. The pressing means or the pressing layer has only a slight pressing force in the case, for example, of a substrate made of plastic, since they are otherwise deformed; consequently, in the case of a substrate made from harder and/or more resistant materials such as glass, porcelain or ceramic, for example, higher dimensional tolerances and/or higher mechanical stability on the part of the substrate mean that somewhat higher pressing forces are also advantageous. The pressing force is approximately 1 N to 1000 N. In the case of a plastic substrate, for example, the pressing force may be about 50 N to 200 N, and in the case of a substrate made of glass, porcelain or ceramic it may be about 75 N to 300 N. In order, additionally, to prevent deformation of plastic parts, the three-dimensional substrate to be decorated may for example be filled with compressed air during the stamping operation, in a holding means designed accordingly.

Advantageously the at least one subregion of the transfer ply provided with adhesive is applied to the substrate 0.2 s to 1.7 s after the precuring of the adhesive. Within this period, the precuring reaction is able to advance without excessive curing of the adhesive, which could detract from the adhesion.

It is further preferred if the substrate, before the application of the at least one subregion of the transfer ply provided with adhesive, is pretreated, in particular by a corona treatment, a plasma treatment or by flaming or by coating with a varnish layer, more particularly a colored varnish layer and/or a primer layer. By this means it is possible to improve the adhesion of adhesive, even in the case of substrates which have poor adhesiveness per se, so that even for such substrates a reliable and sharply defined application of the transfer ply becomes possible.

Preferably the adhesive is fully cured 0.2 s to 1.7 s after the application of the transfer ply to the substrate. At the customary transport velocities of substrate and of foil, a sufficient distance is hence ensured between the roll arrangement and the full-curing station.

It is useful here if the adhesive is cured with UV light at least 90% of whose energy is irradiated in the wavelength range between 380 nm and 420 nm. At these wavelengths, especially with the adhesive formulations outlined above, the full radical curing is set reliably in train.

It is preferred, furthermore, if the adhesive is fully cured with a gross irradiation power of 12 W/cm$^2$ to 20 W/cm$^2$ and/or in particular with a net irradiation power of 4.8 W/cm$^2$ to 8 W/cm$^2$ and/or with an energy input into the adhesive of 200 mJ/cm$^2$ to 900 mJ/cm$^2$, preferably of 200 mJ/cm$^2$ to 400 mJ/cm$^2$. With an energy input of this kind, there is reliable volume curing of the adhesive, so that after the full-curing step, the carrier ply of the foil can be peeled off without damage to the transfer ply applied.

It is advantageous, furthermore, if the adhesive is fully cured with an exposure time of 0.04 s to 0.112 s. With the specified gross irradiation powers and the customary transport velocities, the net energy input required for the volume curing of the adhesive is thereby assured.

It is preferred, furthermore, if the carrier ply is detached 0.2 s to 1.7 s after the full curing of the adhesive. With the customary transport velocities of substrate and foil, a sufficient distance is thereby ensured between the full-curing station and the detachment station.

Alternatively or additionally to the use of the UV-curable adhesive described, provision may be made for a thermoplastic toner to be applied as adhesion promoter to at least one subregion of the substrate and/or of the transfer ply. For the application of the foil, after the application of the foil to the substrate, pressure and heat are introduced onto the foil and/or onto the substrate into this layer assembly in such a way that the thermoplastic toner melts and the transfer ply of the foil joins to the substrate.

This joining, similarly to the application by means of UV-curable adhesive, takes place likewise preferably in a roll arrangement composed of at least two interacting rolls which form a press nip. The roll arrangement consists preferably of at least one press roll and at least one impression roll. The foil and the substrate are guided through the press nip. Here, at least one of the rolls may be directly or indirectly heated, in order to provide the corresponding heat.

The applied pressure in the press nip is able to provide the requisite pressing pressure.

After the foil and the substrate have left the press nip, the layer assembly cools down and the toner hardens again. The carrier ply of the foil can now be peeled off from the foil transfer ply transferred to the substrate at least in the subregion.

The roll arrangement for the application of the foil with UV-curable adhesive to the substrate and the roll arrangement for application of the foil with thermoplastic toner may be identical or else different.

For the implementation of the at least one first, second, third sensor there are a number of possibilities, which may also be combined.

Particularly preferred is the use of optical systems. This refers to all kinds of camera systems with or without their own evaluation unit. The signals generated can then be processed by corresponding software and hence used as a guide criterion. It is also conceivable for the optical systems likewise to deliver a control pulse, which need not be, though may be, explicitly processed.

Furthermore, a variety of sensor systems may be employed, especially reflected light sensors, color sensors, reflective light switches, light barriers (for recognizing sheet edges), ultrasonic sensors (for recognizing sheet edges), laser sensors, transmitted light sensors (for recognizing watermarks and the like) and/or sensors in optical waveguide technology.

Sensors of this kind require an external signal amplifier, but are also available with internally integrated signal amplifiers. For signal processing in this case there is a free choice as to whether the sensor, amplifier or a corresponding output signal is analog or digital.

The signals from the sensors and/or amplifiers may then be processed using corresponding software and hence may be used as a guide criterion. It is also conceivable for these signals from the sensors and/or amplifiers to be used directly as a control pulse. An external software or apparatus for signal processing is therefore not explicitly required.

It is useful, furthermore, if the first UV light source is an LED light source. With LED light sources it is possible to provide virtually monochromatic light, thereby ensuring that the requisite radiation intensity is available in the wavelength range needed for curing of the adhesive. This cannot in general be achieved using conventional medium-pressure mercury vapor lamps.

It is preferred, furthermore, if the first UV light source in the conveying direction of the foil or of the substrate has a window width of 10 mm to 30 mm. This allows the applied adhesive to be irradiated areally.

Usefully the first UV light source in the conveying direction of the foil or of the substrate is disposed 1 cm to 4 cm downstream of the inkjet printhead. With the usual transport velocities of the foil it is possible in this way to observe the abovementioned time between application of adhesive and precuring.

It is further advantageous if the roll arrangement comprises a press roll and a mechanical counterbearing, in particular an impression roll, or else a flat or slightly concavely dished counterbearing.

In particular here the press roll and/or the impression roll have a diameter of 1 cm to 3 cm.

It is preferred, further, if the press roll is formed of a plastic or rubber having a hardness of 70 Shore A to 90 Shore A.

The impression roll or the counterbearing is preferably formed of a material having a degree of hardness in the range from 60° Shore A to 95° Shore A, preferably in the range from 80° Shore A to 95° Shore A, and/or a degree of hardness in the range from 450 HV 10 (HV=Vickers hardness) to 520 HV 10, preferably in the range from 465 HV 10 to 500 HV 10. This material, for example, is plastic or silicone or else a metal such as aluminum or steel.

Within the bounds of the stated ranges, and depending on the properties of the substrate to be processed and the foil to be processed, the material-related parameters and the specific geometry of the roll arrangement may be adapted in order on the one hand to ensure optimum adhesion between transfer ply and substrate and on the other hand to prevent oozing of the adhesive and/or damage to the transfer ply or to the substrate.

Preferably in this case the roll arrangement is disposed at a distance of 10 cm to 30 cm from the first UV light source.

At the customary transport velocities of foil and substrate, the predrying time already elucidated above, between exposure of the adhesive and application of the foil, is thus assured.

Further it is preferred if the second UV light source is an LED light source. With LED light sources it is possible to provide virtually monochromatic light, thereby ensuring that the required radiation intensity is available in the wavelength range necessary for the curing of the adhesive. With conventional medium-pressure mercury vapor lamps, this can generally not be achieved, or can be achieved only with much greater expenditure of energy.

Advantageously here the second UV light source in the conveying direction of the foil or of the substrate has a window width of 20 mm to 40 mm. This ensures areal irradiation of the adhesive.

Preferably the second UV light source in the conveying direction of the foil is disposed 10 cm to 30 cm downstream of the roll arrangement. This ensures a sufficient distance between the roll arrangement and the full-curing station.

It is useful, furthermore, if the peeling unit has a roll having a diameter of 0.5 cm to 2 cm over which the carrier ply can be peeled off.

Preferably the peeling unit in the conveying direction of the foil is disposed 10 cm to 30 cm downstream of the second UV light source.

With the customary foil and substrate transport velocities, the drying time already elucidated above, between application of the foil and detachment of the carrier ply, is thus ensured, and so the carrier ply can be parted free from damage.

BRIEF DESCRIPTION OF THE DRAWINGS

The invention is now elucidated in more detail using exemplary embodiments. In the figures

DETAILED DESCRIPTION OF THE PREFERRED EMBODIMENTS

Figure 1:
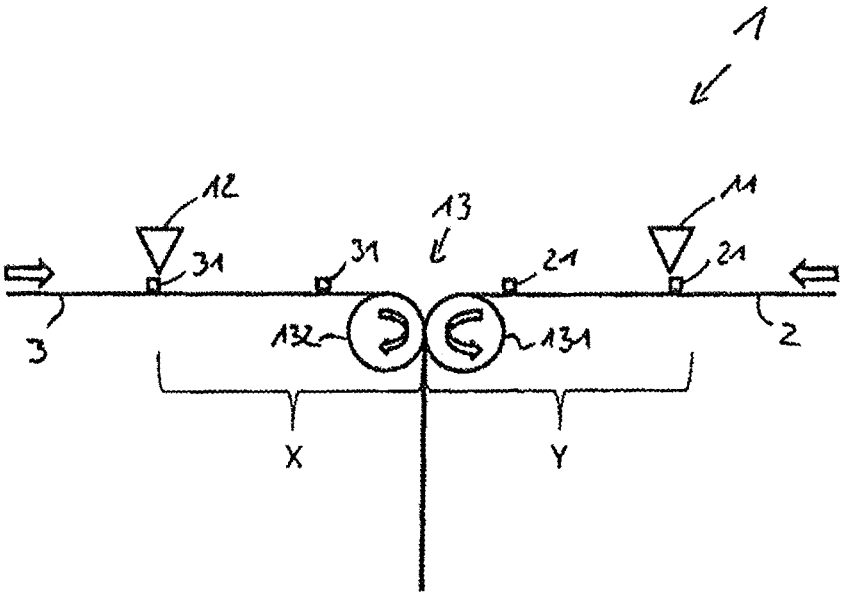
FIG. 1 shows a schematic representation of an application apparatus for applying a foil to a substrate, to illustrate the recognition of the relative position of foil and substrate.

FIG. 1 shows a schematic representation of an apparatus 1 for applying a foil 2, having a carrier ply and a transfer ply, to a substrate 3. In the representation, only the sensor technology for controlling foil advance and substrate advance is shown. Additional components of the apparatus 1 are illustrated schematically in FIG. 2.

On both the foil 2 and the substrate 3 there are registration marks 21, 31, which can be detected by respective sensors 11, 12 of the apparatus 1. Foil advance and substrate advance can be controlled in dependence on the sensor data, and so foil 2 and substrate 3 are brought together in register in a roll arrangement 13 having a pinch roll 131 and an impression roll 132.

Figure 2:
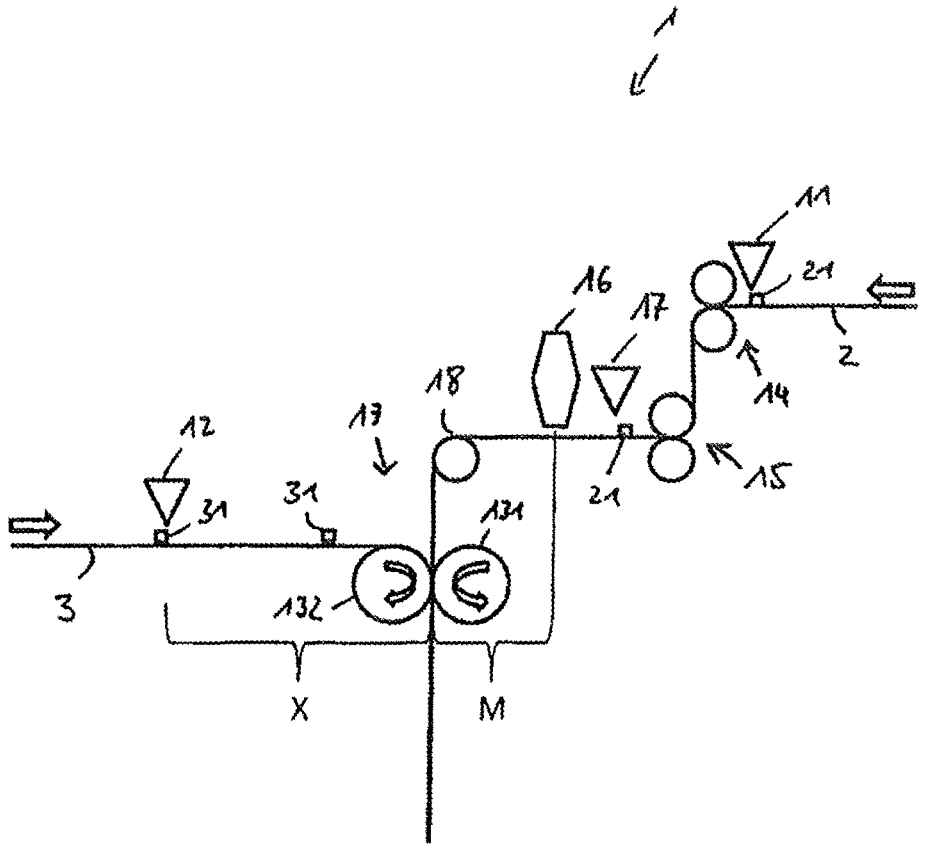
FIG. 2 shows a schematic representation of an application apparatus for applying a foil to a substrate, with sensors for recognizing the relative position of foil, substrate, and an inkjet printhead for adhesive application.

As illustrated by FIG. 2, the foil 2 is guided by means of two traction mechanisms 14, 15 first to an inkjet printhead 16, which applies an adhesive to the transfer ply of the foil 2. In order to allow positionally accurate application of the adhesive, a registration mark 21 of the foil 2 is detected by means of a third sensor 17 upstream of the inkjet printhead 16. Following application of adhesive, the foil 2 is guided via a deflection roller 18 to the roll arrangement 13.

The apparatus 1 may additionally comprise further components not shown in the figures. In particular, corresponding controllable traction mechanisms are provided for the substrate 3 as well. Furthermore, there may be UV lamps provided for the precuring and/or full curing of the adhesive. Additional roller arrangements serve to detach the carrier ply, with remaining, untransferred regions of the transfer ply, from the substrate 3, and to coil up the carrier ply detached.

For the application of the transfer ply to the substrate 3 there are a number of possibilities. In the minimal variant described below, a bare continuous substrate 3 is assumed, which in particular also has no features that can serve as register mark 31. It is further assumed that no register mark on a component traveling along with the substrate 3 (roll, wheel) is employed either. Of course, such features may likewise be integrated into the control or regulation of the apparatus 1.

In the application of the transfer ply, first of all a UV adhesive, as motif-providing layer, is applied to the substrate 3 or to the back of the foil 2. Application of this adhesive takes place in the form of the subsequent foil application or of the subsequent motif. The adhesive here may be printed on in the form of the motif or else, optionally, in the form of the motif and of an additional, separate register mark.

[The foil 2 and the substrate 3 are subsequently brought together with the UV adhesive disposed between foil 2 and substrate 3. In the roll arrangement 13, the foil 2 is pressed against the substrate 3.

Application of the foil 2 to the substrate 3 is followed by UV curing of the UV adhesive with the applied foil 2. After full curing, the carrier ply of the foil 2 is peeled from the substrate 3, together with untransferred regions of the transfer ply, and is wound up. Optionally there may also be recoiling of the foil 2 for the change of direction of the wound foil web. At this point, the first stamping pass is at an end.

If the substrate 3 contains no register marks 31, it is barely possible to bring the stampings of the first pass in register (correct relative spacing) with the stampings of a second pass. This therefore entails a corresponding loss of inherently usable transfer ply between the two passes. With additional register marks 31 on the substrate 3, this problem can be avoided.

At the start of the second stamping process, there is a roll change; in other words, the wound carrier ply with the remaining regions of the transfer ply is mounted on the unwind side.

First of all it is now necessary to detect the regions of the foil 2 that have already been stamped, in other words the regions in which the transfer ply has already been transferred to the substrate 3.

At the start of the second run, this detection may optionally also take place manually or by visual estimate. Preferably, however, it is accomplished by means of optical sensors.

A useful region of the foil 2 thus recognized, in other words an as yet unstamped region of the transfer ply, must now be positioned relative to the printhead 16, if printing takes place onto the back of the foil 2. Otherwise, positioning takes place with respect to an adhesive motif printed on the substrate 3.

At the start of the second run, this positioning may likewise be accomplished manually or by visual estimate. In the ongoing run, this takes place by means of optical sensors 11, 12, 17, the measurement values from which are employed for regulating foil traction by way of the traction mechanisms 14, 15.

Then, with positioning correct, as also in the first stamping run, the foil 2 is brought together with the substrate 3, with the UV adhesive disposed between foil 2 and substrate 3; the film 2 is pressed against the substrate 3 in the roll arrangement 13; the UV adhesive is subsequently UV-cured with the applied transfer ply; and the foil 2, together with untransferred regions of the transfer ply, is peeled off and wound up.

If there are still sufficiently large stampable regions of the transfer ply present on the foil 2, it is possible subsequently for a further stamping process to take place in the manner described.

More precise control is possible if register marks 31 have been provided on the substrate 3 as well. With this variant, therefore, three elements must be positioned in register with one another, namely the substrate 3 with possibly motifs thereon, such as printed decorations, and/or a predetermined useful region of the substrate 3; the UV adhesive, as motif-providing layer for the foil 2 transfer ply to be applied; and also the transfer ply of the foil 2, optionally bearing motifs or a continuous design.

In order to ensure in-register alignment between these elements, register marks 21, 31 are necessary. These may also be any embodiment of control marks, printing marks, raised portions of the foil 2, design features of foil 2 or substrate 3, sheet edges of foil 2 or substrate 3, or any other kind of guidance and/or control criteria.

Such control criteria can be or must be present and/or generated on the substrate 3, the foil 2, and/or else on the printhead 16. It is also conceivable for registration to be able to be carried out by means of a control signal from the software for driving the substrate supply and/or the foil supply and/or the printhead driver.

It is conceivable, furthermore, that the registration and/or a controlling-guiding signal or pulse, detected mechanically via the system, can be recorded. For example, on a transport roll for the substrate 3 and/or the foil 2, or on a corresponding co-rotating element (wheel, roller), a marking may be disposed which can be detected by means of optical sensors. In this way as well it is possible to detect length and/or time data relating to the position of foil 2, substrate 3 and/or printhead 16.

The specific design of the register marks 21, 32 and also, where appropriate, of markings on co-travelling parts of the apparatus, is not subject to any specific rules, but must merely be adapted to the sensors 11, 12, 17.

For these sensors 11, 12, 17, the use of optical systems is particularly preferred. This refers to all kinds of camera systems with or without their own evaluation unit. The signals generated can then be processed by corresponding software and therefore used as a guide criterion. It is also conceivable to have the optical systems likewise deliver a control pulse, which need not, but also can, be explicitly processed.

It is possible, furthermore, to employ various sensor systems, especially reflected light sensors, color sensors, reflective light switches, light barriers (for recognizing sheet edges), ultrasonic sensors (for recognizing sheet edges), laser sensors, transmitted light sensors (for recognizing watermarks and the like) and/or sensors in optical waveguide technology.

Such sensors 11, 12, 17 require an external signal amplifier, but are also available with internally integrated signal amplifiers. For signal processing it is immaterial whether the sensor, amplifier or a corresponding output signal in question is analog or digital.

The signals from the sensors 11, 12, 17 and/or amplifiers may then be processed by corresponding software and hence used as a guide criterion. It is also conceivable for these signals from the sensors 11, 12, 17 and/or amplifiers to be used directly as a control pulse. Accordingly, external software and/or apparatus for signal processing is not explicitly required.

In the text below, the pure positioning of the foil 2 relative to the substrate 3 is described in detail, initially without regard to the printhead 17. The sensor 12 is provided for this purpose and, as described above, may be optical, sensory and or mechanical, and is mounted in the region of the substrate feed. It should be borne in mind that the adhesive print may take place onto the substrate 3 or onto the foil 2. The particular embodiment selected, however, has no substantial influence on the principles of the control or regulation of the apparatus 1.

The sensor 12 must be situated in front of the roll arrangement 13. It has emerged that a distance to roll arrangement 13 of 10 mm to 800 mm is particularly advantageous. Clean registration of motifs, etc., with one another can be accomplished only before the permanent joining, in other words before foil application to the substrate 3 in the roll arrangement 13, since after that it is no longer possible to exert any influence on this registration.

It is, however, also possible to accomplish verification of the register accuracy after the roll arrangement 13, although in that case the subject under consideration is no longer the motif that has just been applied, but rather the subsequent motif. Here it is possible to determine deviation in the subregion of the transfer ply that has just been applied, and to generate corresponding correction instructions, where appropriate, to the traction mechanisms 14, 15. This mode is normally used for a control loop.

The distance of the sensor 11 or 12 in front of the roll arrangement 13, of 10 mm to 800 mm, is made up of the distance of the roll arrangement 13 to the traction mechanism 15, the distance of the roll arrangement 13 to the printhead 16, the signal processing time for the printhead 16, the web speed of the substrate 3 and of the foil 2, and the signal processing of the sensors 11 and 12, respectively.

Serving below as an example is the application scenario with a printhead 16. At a web speed of around 70 m/min, the software of the printhead 16 requires an initial travel section to the roll arrangement 13 (placing of the mark sensors 11 and 12 in front of the roll arrangement 13) of approximately 300 mm in order to process the signal. The sensor 12 for recognizing the substrate mark must therefore be positioned at least 300 mm in front of the roll arrangement 13.

It is also necessary to take account of the distance from the printhead 16 to the roll arrangement 13, this distance being dictated by construction. This distance is therefore an offset value, since the foil position at which the printhead 16 prints is required to traverse this section to the roll arrangement 13, while the substrate 2 at the same time is also moving forward. It is therefore necessary for this distance to be added onto the distance between substrate mark sensor 12 and roll arrangement 13. In this example, this distance is about 350 mm. An overall initial-run section from the substrate sensor 12 to the roll arrangement 13 is therefore 300 mm+350 mm, in other words 650 mm.

In the example just described, the register signal of the sensor 12 functions as a control signal, in other words as what is called a master, and hence as a guide signal for all subsequent regulation procedures.

The foil supply unit consists of foil unwinders, traction mechanisms 14, 15, and foil rewinders. The traction mechanism 14, 15 may be equipped with stepper motor technology, sensor technology, etc. It is conceivable for the unit to consist in each case only of one component, of two or more components, or of a mixture of the abovementioned components. Additionally, this unit may be equipped with dancers, foil accumulators, etc.

The apparatus 1 may also have two or more foil webs and/or foil tracks. In that case it is necessary for each foil web requiring registration to be equipped with a respective sensor 11.

For registration of a single-image foil 2, it is necessary for a defined guide criterion to be installed in the foil. Here again, the form, as for example the geometric design, color, the design as diecut, stamp or watermark, the use of a mechanical component in the machine (co-travelling "virtual mark" on a roll or on a linear unit), etc., as guide criterion is not subject to any special rules.

A continuous decoration may further be aligned by means of its stamping-out (i.e., the gap produced in the transfer ply) after the first stamping run, with the stamping-out then functioning as a guide criterion. Here as well, the design of the stamping-out used for guidance is freely selectable.

The relative positioning of the foil 2 to the substrate 3 takes place preferably by way of the foil extension. This is explained in more detail below.

As shown by FIG. 1, the read distance between substrate mark sensor 12 and roll arrangement 13 is X mm, and the distance of the foil mark sensor 11 to the roll arrangement 13 is Y mm. Since, in this specific case of cold foil stamping in permanent running, the foil 2 and the substrate 3 are in synchronism, the distance X must be greater than or equal to the distance Y for registration of the marks or images, or of foil 2 with respect to the substrate 3.

The minimum difference, however, must not be too great. It has emerged that a minimum offset of 0 mm to 10 mm is acceptable.

For the consideration of the registration process below, an offset of 0 mm is set as a precondition.

The foil is generally conveyed with a basic extension of Z ‰ of 1 to 6‰, preferably 3‰, relative to the repeat length, in other words the spacing between successive marks 21, this conveying taking place constantly to the substrate 3. In normal operation, therefore, the foil 2 is always slightly pre-extended.

In order to place the two control marks 21, 31 over one another, the foil mark sensor 11 is positioned in slave mode to the substrate 3 with its mark 31. This is accomplished via a slight change in foil extension, by the traction mechanism 14, 15 on the foil 2 braking the foil 2 to a greater or lesser degree, resulting in a reduced or increased foil extension Z±M ‰. Through this change in tension or extension it is possible for the guide criteria to be positioned relative to one another. For this reason it is also possible to realize the above-depicted minimum difference between X and Y, since a certain difference can be compensated by means of the foil extension. It is also possible to operate with a certain slight offset which is then likewise reflected in the foil extension.

For in-register application of the transfer ply of the foil 2 onto the substrate 3, furthermore, a precise positioning of the UV adhesive print relative to the substrate 3 and/or to the foil 2 is necessary. For this variant of the method there are various sensor arrangements that can be employed.

In a first variant there is only one sensor 12 for recognizing the substrate mark 31. This is suitable for foils 2 with continuous design, which are to be processed in only one stamping run. The sensor 12 for the substrate mark 31 in this case ensures the foil decoration at the intended site on the substrate 3.

In a second variant there are two sensors 11, 12. This is suitable for foils 2 with individual-image design which are processed in only one stamping run. A sensor 12 for the substrate mark 31 and a sensor 11 for the foil mark 21 are sufficient here to ensure the positioning of the individual foil image at the intended site on substrate 3.

The most accurate control is possible in an apparatus 1 having three sensors. With this it is possible to process a foil 2 with individual-image design in a plurality of stamping runs. Sensors 11, 12 for the substrate mark 31 and for the foil mark 21 ensure the desired relative position between foil 2 and substrate 3. For the positioning of the adhesive print on foil 2, in other words for the driving of the printhead 16, a further sensor 17 is provided. With this it is possible to control with accuracy not only the positioning of the individual foil image at the intended site on the substrate 3 but also the positioning of the adhesive print onto the foil 2.

A complete system composed of substrate 3, foil positioning, and inkjet printhead 16 for implementing the latter method is described below with reference to FIG. 2.

Overall, therefore, as described, a sensor 12 for the substrate 3, a sensor 11 for the registration of the foil 2 relative to the substrate 3, and a sensor 17 for the registration of the printhead 16 relative to the foil 2 are required. A foil traction mechanism 15 between the first traction mechanism 14 and the printhead 16 allows registration of the foil 2 between the two traction mechanisms 14 and 15 onto the master signal, generated by the sensor 12, with respect to the substrate 3. The two traction mechanisms 14, 15 displace the positioning of the foil 2 to the substrate 3 upstream in the foil course, in front of the printhead 16, by way of the foil extension. At the printhead 16, therefore, the foil 2 is already correctly positioned and need not subsequently be extended again. Consequently, the adhesive print provided on the foil 2 is also, advantageously, not co-extended as well, and so the printed image is not distorted.

With regard to the driving of the apparatus 1, the signals of the sensors 11, 12, 17 must be considered as separate systems. Serving as master in the case described is the control mark 31 detected by the sensor 12 on the substrate 3. This is the so-called lead signal. Oriented on this signal are, firstly, the alignment and/or extension of the foil 2 by the traction mechanisms 14, 15 and/or, secondly, the positioning of the printhead 16, which is supported by the sensor 17 for re-reading the foil mark 21. As already described above, therefore, the foil 2 is positioned to the extent that the foil mark 21 is able to serve as a print start signal for the printhead 16.

For the functioning it is necessary for the distance from the substrate mark 31 to the roll arrangement 13, referred to below as X, to be greater than or equal to the distance from the roll arrangement 13 to the printhead 16, hereinafter called M. A very largely equal distance is ideal, but if X>M, the time of printing can be adjusted accordingly via an offset value in the control (for example, a time delay or via a fixed foil path through non-driven print lines on the printhead 16). The start signal may be processed in the printhead control, or externally.

In total, therefore, there are up to three input variables—i.e., the measured data from the sensors 11, 12, 17—and three controlled variables, in particular the rate of advance and/or the extension of foil 2 and substrate 3, and also the positioning of the inkjet printhead 16, available for the control or regulation of the application apparatus 1. This results in a plurality of possibilities for implementing the control or regulation logic system.

On the one hand it is possible for the traction mechanisms 14, 15 for the foil 2 to be controlled or regulated as a function of the substrate mark 31.

In that case it is useful if the transport apparatus for the substrate 3 and/or the inkjet printhead 16 is controlled and/or regulated as a function of a control datum for the traction mechanisms 14, 15 and the foil mark 21.

In this case, therefore, the datum concerning the substrate 3 serves as the master input variable, and control takes place in dependence on this variable. This control can in turn be implemented in a variety of ways.

First of all it is possible to implement control with the print mark sensor 31 of the substrate 3, in other words with the sensor 11, in accordance with which the rate of advance of the foil 2 and also the inkjet printhead 16 are controlled.

Alternatively, the print mark sensor 31 of the substrate 3 can be used for control, and, in dependence on this, there can be regulation of the foil 2 and subsequent regulation or driving of the inkjet printhead 16 by the foil mark 21, in other words the measurement values from the sensor 11 or 17, respectively.

It is also possible to do without regulation of the transport of the foil 2. Here there is only regulation of the printing by the foil mark 21, in other words the sensor 11, or else by the print mark 31 of the substrate 3, in other words the sensor 12.

Furthermore, control may be implemented with the print mark sensor 31 of the substrate 3, and also with regulation of the foil 2 on the basis of the data from the sensor 12, in which case it is possible to omit regulation of the print.

Alternatively, the transport apparatus for the substrate 3 may also be controlled or regulated in dependence on the sensor 11, in other words on the foil mark 21.

In that case it is useful if the traction mechanisms 14, 15 and/or the inkjet printhead 16 are controlled and/or regulated as a function of a control datum for the transport apparatus for the substrate 3 and as a function of the data from the sensors 12, 17.

In this event, therefore, the datum relating to the foil 2 serves as the master input variable, and control takes place as a function of this variable. This control may likewise be implemented, in turn, in a variety of ways.

Here as well it is possible to implement control with the print mark sensor 21 of the foil 2, in other words the sensor 11, according to which the rate of advance of the substrate 3 and also the inkjet printhead 16 are controlled.

Alternatively, the print mark sensor 21 of the foil 2 can be used for control and, in dependence thereon, regulation of the substrate advance and subsequent regulation or driving of the inkjet printhead 16 may take place through the substrate mark 31, in other words the measurement values from the sensor 12.

It is also possible to do without regulation of the transport of the substrate 3. In that case there is only regulation of the print by the substrate mark 31, in other words the sensor 12, or else by the registration mark 21 of the foil 2, in other words the sensor 11.

Furthermore, control with the print mark sensor 11 of the foil 2 may also be implemented with regulation of the substrate 3 on the basis of the data from the sensor 11, in which case it is possible to do without regulation of the print.

Regulation using the substrate mark 31 is preferred here as a master variable.

Figure 3:
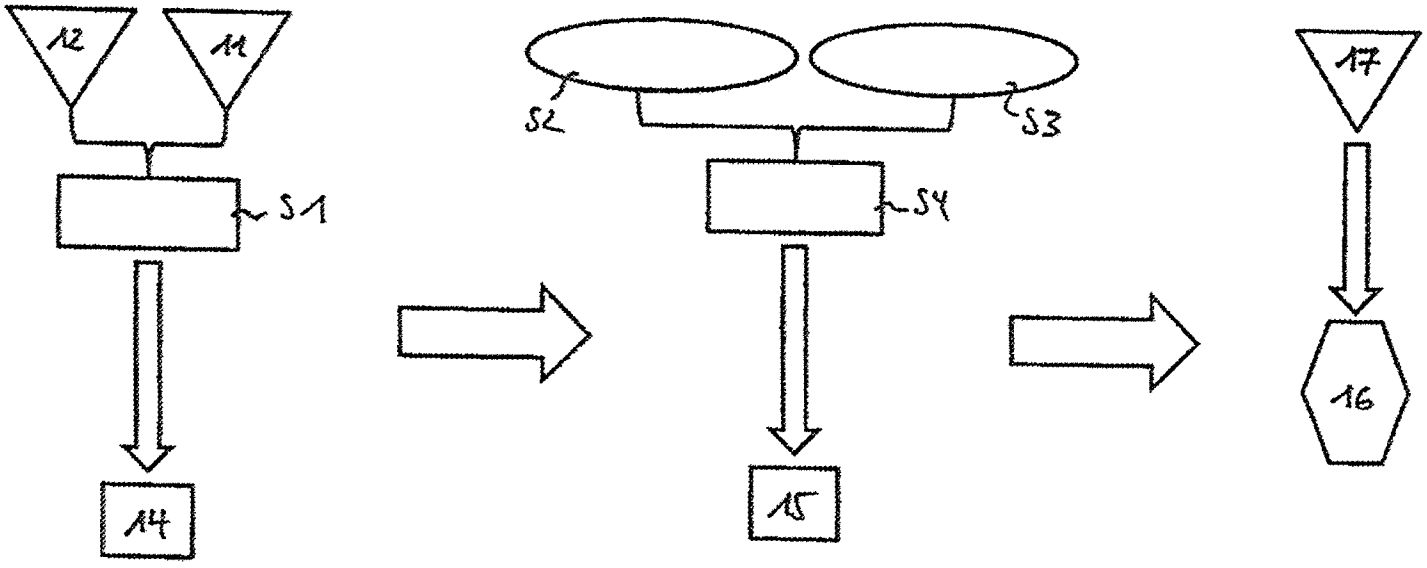
FIG. 3 shows a schematic control circuit scheme for driving an application apparatus according to FIG. 2.

An exemplary control circuit for this purpose is illustrated in FIG. 3. In a first step S1, the data from the sensors 11 and 12 are captured and a target/actual comparison is carried out. The data from the sensor 12, in other words the position of the substrate mark, serve as master signal. In the event of deviations from the relative target position between substrate mark and foil mark, the traction mechanism 14 is accelerated or braked accordingly.

At the same time, in steps S2 and S3, the web speed of foil 2 and substrate 3 is monitored, and in step S4, likewise, a target/actual comparison is carried out. If the web speeds deviate from one another, particularly on account of an above-described change at the traction mechanism 14, then the traction mechanism 15 is driven correspondingly for the correction.

In a further, parallel process to this, the printhead 16 is regulated as a function of the data from the sensor 17 and as a function of a fundamental control data set mandated by the pattern to be printed.

Overall, therefore, all variables of the system are regulated as a function of the position of the substrate mark 31 as detected by means of the sensor 12.

Below, additional elucidation is given of the other components of the apparatus 1, those not directly connected with the registration of adhesive printing, foil 2 and substrate 3, these components nevertheless being essential to the application of the transfer ply of the foil 2 onto the substrate.

The inkjet printing takes place by way of a piezoelectric drop-on-demand printhead 16. For high-quality results, the printhead 16 must possess a particular physical resolution, droplet size, and nozzle spacing. These nozzles may be arranged in one or more rows. The physical resolution ought to be 300 npi to 1200 npi (nozzles per inch). A small nozzle spacing transverse to the printing direction ensures that the printed pixels likewise are close to one another transverse to the printing direction, or overlap, depending on quantity of adhesive.

Generally speaking, the npi correspond to the dpi (dots per inch) on the print medium, in other words either on the substrate 3 or on the foil 2. When using the gray stage technology offered by certain printheads 16, gray stages are generated by different quantities of ink per printed pixel. The gray stages are generally produced by firing of a plurality of droplets of virtually identical size onto a printed pixel, these droplets combining while still in the flight phase to the substrate to form a larger drop of ink. The quantity of adhesive on the print medium behaves in analogy to the gray stages.

The quantity of adhesive must be varied according to the absorbency of the substrate 3 or of the transfer ply of the foil 2, respectively. The quantity of adhesive on the foil 2 must be 1.6 to 7.8 g/m$^2$ in order to ensure complete foil application to every substrate 3. The layer thicknesses of the applied adhesive are then 1.60 μm to 7.80 μm. For optimum wetting of the primer layer of the foil 2 with adhesive, this layer ought to have a surface tension of 38 to 46 mN/m, with the range from 41 to 43 mN/m in particular ensuring optimum ink acceptance.

The nozzle spacing ought to be 30 to 80 μm. In order to ensure high resolution in the printing direction, the piezoelectric actuator of the printhead 16 is required to fire off the droplets of adhesive with a frequency of 6 to 110 kHz, which for print-medium speeds of 10 m/min to 75 m/min produces a resolution on the print medium of 600 to 1200 dpi.

The pressure within the nozzle chamber is preferably 10 mbar to 15 mbar and ought not to be exceeded, in order not to damage the piezoelectric actuator. The spacing of the nozzle plate of the printhead 16 relative to the foil 2, or to the substrate 3, respectively, ought not to exceed 1 mm, in order to minimize the effect of drafts of air in diverting the fine droplets of adhesive.

The droplet volume ought to be 2 pl to 50 pl, with a tolerance of ±6% of the droplet volume. In this way, for a given resolution, the necessary quantity of adhesive is applied uniformly to the print medium. The pixel size resulting from the droplet is dependent on the viscosity of the liquid.

The droplet viscosity in flight ought to be 5 to 10 m/s with a tolerance of not more than ±5%, so that all of the droplets of adhesive land very precisely alongside one another on the print medium. If the droplet velocity of the individual droplets deviates too greatly from one another, this is manifested in an uneven printed image.

For optimum printability of the liquid, the viscosity of the liquid to be printed ought to be 5 to 20 mPas, typically 7 mPas to 9 mPas. In order to ensure consistent liquid viscosity, it is necessary for the printhead 16 or the adhesive supply system to be heated. For the corresponding viscosity, the adhesive temperature in operation ought to be 40 to 45° C. Droplet flight and impingement on the print medium cause an increase, as a result of cooling, in the viscosity of the droplet of adhesive, likely to 20 mPas to 50 mPas. An increase in the viscosity counteracts any running or spreading of the adhesive on the print medium.

The adhesive employed is preferably a light gray UV-curing ink for use in piezoelectric drop-on-demand inkjet printheads 16. By energy input in the form of UV light, a radical chain reaction is triggered in the adhesive. In this reaction, polymers and monomers combine to form a solid network of molecules. The adhesive becomes hard or dry. The chain reaction is triggered by UV light in a wavelength range from 350 to 400 nm±10 nm.

The key difference between cationically curing adhesives and the radically curing system used here is that the cationic mechanism is substantially slower, i.e., through-curing takes longer. For foil application, however, a quick-curing system is needed, since otherwise it would not be possible to apply the foil 2 completely. In the course of UV irradiation of cationic adhesives, moreover, an acid is formed, and is responsible for the through-curing of the adhesive. Owing to this mechanism, print media must first be checked for compatibility for cationic systems, since alkaline or basic substances of some substrate surfaces may influence or prevent the through-curing of the adhesive. This is unnecessary here.

The adhesive preferably has the composition as follows:

| | |
|---|---|
| 2-phenoxyethyl acrylate | 10% to 60%, preferably 25% to 50%; |
| 4-(1-oxo-2-propenyl)morpholine | 5% to 40%, preferably 10% to 25%; |
| exo-1,7,7-trimethylbicyclo[2.2.1]hept-2-yl acrylate | 10% to 40%, preferably 20% to 25%; |
| 2,4,6-trimethylbenzoyldiphenyl phosphine oxide | 5% to 35%, preferably 10% to 25%; |
| dipropylene glycol diacrylate | 1% to 20%, preferably 3% to 10%; |
| urethane acrylate oligomer | 1% to 20%, preferably 1% to 10%; |
| carbon black pigment | 0.01%-10%, preferably 0.1% to 0.5%. |

With preference there is partial curing of the adhesive (also called UV pinning), spatially and temporally almost directly after the process of printing onto the foil 2. Only in this way is it possible to fix the defined, sharp motif on the foil 2. This fixing is brought about by an increase in viscosity of the adhesive, induced by partial triggering of the radical chain reaction.

In terms of space, the partial curing takes place preferably 1 to 4 cm after the printing in machine direction, corresponding to a temporal spacing in machine direction of approximately 0.02 to 0.25 s (for a web speed of 10 to 30 m/min).

The UV pinning unit ought to produce a gross UV irradiation power of 2 to 5 W/cm$^2$ in order to bring the necessary and optimum energy input into the adhesive. 90% of the UV light delivered ought to be situated in the wavelength spectrum between 380 and 420 nm. This requirement can only be met by LED UV systems, since these systems deliver virtually monochromatic UV light, and the wavelength spectrum delivered is therefore much narrower than in the case of conventional medium-pressure mercury vapor lamps, for which the emitted spectrum encompasses a relatively large wavelength range. The window from which the radiation emerges ought to be approximately 10 mm to 30 mm in size in the machine direction, in order to allow the adhesive to be irradiated over its area.

Depending on web velocity and foil velocity of around 10 m/min to 100 m/min, more particularly around 10 m/min to 75 m/min (or more), and through absorption and reflection of 50% to 60% of the UV light by the foil, the UV dose (mJ/cm$^2$) penetrating to the adhesive is reduced. Additionally, the distance between the UV pinning lamp and the foil web lowers the irradiation power delivered, by approximately 10% in the case of an irradiation distance of 2 mm, for example. This dose can additionally be adapted via the web velocity, since to do so changes the irradiation time.

As already described, the viscosity of the droplets of adhesive on the foil has already increased to likely 20 mPas to 50 mPas prior to the partial curing, as a result of cooling. The partial curing drives change in viscosity further forward. After the partial curing, the droplets have a viscosity of likely 50 mPas to 200 mPas, a figure which may vary according to the layer thickness of the adhesive. This fixes the adhesive reliably on the print medium. The motif on the foil 2, though fixed, is nevertheless still moist and can be printed onto the substrate 3 in the next step.

At this point in the operation, the foil 2 with the adhesive, which is still wet and has the viscosity mentioned above, is pressed onto the substrate 3. The pressure, in the form of a linear pressing, is generated by a press roll 131 and an impression roll 132.

The press roll 131 ought to consist of a solid plastic or rubber with a smooth surface, and ought to have a hardness of 70 to 90 Shore A. The impression roll 132 is preferably made of steel and has a hardness of 100 Shore A. The radius of the press roll 131 ought to be 1 cm to 20 cm, and that of the impression roll 132 ought to be 1 cm to 20 cm.

In spatial terms, the roll arrangement is disposed approximately 10 cm to 30 cm after the partial curing of the adhesive in machine direction, corresponding to a temporal spacing of approximately 0.2 to 1.7 s (for a web speed of 10 m/min to 30 m/min). The linear pressing ought to take place with a force of between 10 N to 80 N, depending on the nature of the substrate.

The wet adhesive with the foil 2 may be applied to various substrates 3. The foil 2 may be applied, for example, to paper substrates with a coated or uncoated surface, natural papers, plastics (PE, PP, PET), and label materials, and also to glass or ceramic. In the case of substrates made of plastic, glass or ceramic, a pretreatment may be useful in order to improve the adhesion of the adhesive to the substrate 3, such pretreatment taking place, for example, by corona, by plasma or by flaming). The application outcome is better in the case of smoother substrate surfaces.

As a result of the partial curing and the associated change in viscosity of the adhesive, the application outcomes even on rough substrates 3, however, are improved significantly in comparison to the conventional method without change in viscosity. After the foil 2 has been pressed onto the substrate 3, the foil 2 with the adhesive, which is still wet, remains on the substrate 3 until the adhesive has undergone through-curing, and the carrier ply of the foil 2 is peeled off.

Similar to the description given in reference to the precuring of the adhesive, application of the foil 2 to the substrate 3 is followed by the ultimate, full curing (postcuring) of the adhesive with the foil 2 on the substrate 3. In this step, the foil 2 bears very closely against the still-wet adhesive on the substrate 3 and by through-curing of the adhesive is able to enter into a firm and smooth bond with the substrate 3.

Through-curing takes place with a strong LED UV lamp, which supplies a high irradiation power and ensures complete radical chain reaction within the adhesive. The reasons for the use of an LED UV system, and the factors for the irradiation power, have already been described with reference to the precuring and are valid for this operating step as well.

In spatial terms, through-curing takes place approximately 10 to 30 cm after foil application in the machine direction, to a temporal distance of approximately 0.2 s to 1.7 s (at a web speed of 10 m/min to 30 m/min) after application. The distance between the lamp and the foil substrate web is preferably 1 mm to 10 mm, in order to achieve optimum through-curing but at the same time to prevent physical contact between the lamp and the substrate 3.

The irradiation window of the lamp in machine direction ought to be 20 mm to 40 mm in size. The gross UV irradiation power ought to be between 12 W/cm$^2$ and 20 W/cm$^2$, so that the adhesive is completely through-cured with speeds of 10 m/min to 30 m/min (or higher) and with the other factors already mentioned above.

It should be noted that these values are possible only theoretically (at 100% lamp power). At full power of the UV lamp, in the case of a 20 W/cm$^2$ version, for example, and at a low web velocity, 10 m/min, for example, the foil substrate web becomes heated to such an extent that it can catch fire. After the through-curing, the foil 2 adheres completely to the adhesive and the adhesive adheres completely to the substrate 3. The carrier ply of the foil 2 can now be peeled off.

In spatial terms, the detachment of the carrier ply takes place preferably approximately 10 cm to 30 cm after the through-curing in machine direction, corresponding to a temporal distance of approximately 0.2 s to 1.7 s (for a web speed of 10 m/min to 30 m/min). The carrier ply for detachment is preferably passed over a detachment edge, which allows contactless detachment of the carrier by means of an air cushion. The substrate 3 is now fully finished.

The detached carrier ply, with the remaining, unstamped regions of the transfer ply, can now, as described, be rolled up, recoiled, and supplied for a further stamping pass.

LIST OF REFERENCE SYMBOLS

1 Apparatus
11 Sensor
12 Sensor
13 Roll arrangement
131 Pinch roll
132 Impression roll
14 Traction mechanism
15 Traction mechanism
16 Printhead
17 Sensor
18 Deflection roller
2 Foil
21 Registration mark (on foil)
3 Substrate
31 Registration mark (on substrate)
S1 . . . S4 Method steps

The invention claimed is:

1. A method for applying a transfer ply of a foil to a substrate, comprising:

a) transporting the foil to the substrate with a foil transport apparatus;

b) regionally applying a radically curable adhesive to the transfer ply of the foil and/or the substrate by means of an inkjet printhead;

c) precuring the adhesive by UV irradiation;

d) applying the transfer ply to the substrate by means of a stamping apparatus;

e) fully curing the adhesive by UV irradiation;

f) peeling a carrier ply of the foil, to leave at least one first subregion of the transfer ply on an application region of the substrate, and at least one second subregion of the transfer ply on the carrier ply;

g) winding up or recoiling the carrier ply with the remaining second subregion of the transfer ply; and h) applying at least one further subregion of the transfer ply remaining on the carrier ply to the substrate by at least once repeating steps a) to g), wherein the foil transport apparatus sets extension of the foil to a value of 1% to 6%, and wherein, to set a defined relative position between the foil and the substrate or between the foil and the inkjet printhead, the foil transport apparatus varies the extension of the foil on the basis of at least one positional data value.

2. The method as claimed in claim 1, wherein, by means of at least one first sensor, a positioning feature on the foil or the foil transport apparatus is detected and at least one first positional datum relating to the foil is generated.

3. The method as claimed in claim 2, further comprising transporting the substrate with a substrate transport apparatus, wherein, by means of at least one second sensor, a positioning feature on the substrate or the substrate transport apparatus is detected and at least one second positional datum relating to the substrate is generated.

4. The method as claimed in claim 3, wherein, the positioning feature on the substrate or the positioning feature on the foil is or comprises a registration mark provided during production of the substrate or a registration mark applied by means of the inkjet printhead or a design feature of the substrate or the foil or a sheet edge of the substrate or the foil.

5. The method as claimed in claim 3, wherein, by means of at least one third sensor, a positioning feature on the foil or the foil transport apparatus in the region of the inkjet printhead is detected and at least one third positional datum relating to the foil is generated.

6. The method as claimed in claim 3, wherein, at least one of the positional data is generated or corrected or verified on the basis of control commands transmitted beforehand to the substrate transport apparatus or the foil transport apparatus or the inkjet printhead.

7. The method as claimed in claim 3, wherein, the at least one subregion and/or the at least one further subregion are brought into a defined relative position to the inkjet printhead and/or to the application region of the substrate, as a function of at least one of the positional data.

8. The method as claimed in claim 7, wherein the foil transport apparatus is controlled or regulated as a function of the at least one second positional datum.

9. The method as claimed in claim 8, wherein the substrate transport apparatus or the inkjet printhead are controlled or regulated as a function of a control datum for the foil transport apparatus and of the first or third positional datum.

10. The method as claimed in claim 7, wherein the substrate transport apparatus is controlled or regulated as a function of the at least one first positional datum.

11. The method as claimed in claim 10, wherein the foil transport apparatus or the inkjet printhead are controlled or regulated as a function of a control datum for the substrate transport apparatus and of the second or third positional datum.

12. The method as claimed in claim 1, wherein the adhesive is applied using an inkjet printhead having a resolution of 300 to 1200 applicator nozzles per inch (npi).

13. The method as claimed in claim 1, wherein the adhesive is applied using an inkjet printhead having a nozzle diameter of 15 μm to 25 μm and/or a nozzle spacing of 30 μm to 80 μm.

14. The method as claimed in claim 1, wherein the adhesive is applied with a coat weight of 1.6 $g/m^2$ to 7.8 $g/m^2$ and/or with a layer thickness of 1.6 μm to 7.8 μm to the at least one subregion.

15. The method as claimed in claim 1, wherein the inkjet printhead provides drops of adhesive having a frequency of 6 kHz to 110 kHz.

16. The method as claimed in claim 1, wherein the inkjet printhead provides drops of adhesive having a volume of 2 pl to 50 pl with a tolerance of not more than ±6%.

17. The method as claimed in claim 1, wherein the inkjet printhead provides drops of adhesive having a flight velocity of 5 m/s to 10 m/s with a tolerance of not more than ±15%.

18. The method as claimed in claim 1, wherein the adhesive is applied with an application temperature of 40° C. to 45° C. and/or with a viscosity of 5 mPas to 20 mPas.

19. The method as claimed in claim 1, a spacing between inkjet printhead and substrate and/or foil during application of the adhesive does not exceed 1 mm.

20. The method as claimed in claim 1, wherein a relative velocity between inkjet printhead and substrate and/or transfer ply during application of the adhesive is 10 m/min to 100 m/min.

21. The method as claimed in claim 1, wherein an adhesive with the following volume composition is used:

| | |
|---|---|
| 2-phenoxyethyl acrylate | 10%-60%, |
| 4-(1-oxo-2-propenyl)morpholine | 5%-40%, |
| exo-1,7,7-trimethylbicyclo[2.2.1]hept-2-yl acrylate | 10%-40%, |
| 2,4,6-trimethylbenzoyldiphenyl phosphine oxide | 5%-35%, |
| dipropylene glycol diacrylate | 1%-20%, |
| urethane acrylate oligomer | 1%-20%, |
| carbon black pigment | 0.01%-10%, |

22. The method as claimed in claim 1, wherein an adhesive having a density of 1 g/ml to 1.5 g/ml, is used.

23. The method as claimed in claim 1, wherein the adhesive is precured 0.02 s to 0.25 s after the adhesive has been applied.

24. The method as claimed in claim 1, wherein the adhesive is precured with UV light, at least 90% of whose energy is irradiated in the wavelength range between 380 nm and 420 nm.

25. The method as claimed in claim 1, wherein the adhesive is precured with a gross irradiation power of 2 $W/cm^2$ to 5 $W/cm^2$ and/or with a net irradiation power of 0.7 $W/cm^2$ to 2 $W/cm^2$ and/or with an energy input into the adhesive of 8 $mJ/cm^2$ to 112 $mJ/cm^2$.

26. The method as claimed in claim 1, wherein the adhesive is precured with an exposure time of 0.02 s to 0.056 s.

27. The method as claimed in claim 1, wherein, when the adhesive is precured, its viscosity increases to 50 mPas to 200 mPas.

28. The method as claimed in claim 1, wherein the at least one subregion of the transfer ply provided with adhesive is applied to the substrate between a press roll and an impression roll.

29. The method as claimed in claim 1, wherein the at least one subregion of the transfer ply provided with adhesive is applied to the substrate with an applied pressure of 10 N to 80 N.

30. The method as claimed in claim 1, wherein the at least one subregion of the transfer ply provided with adhesive is applied to the substrate 0.2 s to 1.7 s after the precuring of the adhesive.

31. The method as claimed in claim 1, wherein the substrate, before the application of the at least one subregion of the transfer ply provided with adhesive, is pretreated, by a corona treatment, a plasma treatment or by flaming.

32. The method as claimed in claim 1, wherein the adhesive is fully cured 0.2 s to 1.7 s after the application of the transfer ply to the substrate.

33. The method as claimed in claim 1, wherein the adhesive is fully cured with UV light at least 90% of whose energy is irradiated in the wavelength range between 380 nm and 420 nm.

34. The method as claimed in claim 1, wherein the adhesive is fully cured with a gross irradiation power of 12 $W/cm^2$ to 20 $W/cm^2$ or with a net irradiation power of 4.8 $W/cm^2$ to 8 $W/cm^2$ or with an energy input into the adhesive of 200 $mJ/cm^2$ to 900 $mJ/cm^2$.

35. The method as claimed in claim 1, wherein the adhesive is fully cured with an exposure time of 0.04 s to 0.112 s.

36. The method as claimed in claim 1, wherein the carrier ply is detached 0.2 s to 1.7 s after the full curing of the adhesive.

37. The method as claimed in claim 1, wherein the inkjet printhead is driven by provision of a digital data set which defines those regions in which the adhesive is to be applied.

38. The method as claimed in claim 1, wherein the transfer ply is applied to the substrate by means of a thermoplastic toner at a temperature of 100° C. to 250° C., and at an applied pressure of 1 bar to 6 bar.

39. The method as claimed in claim 1, wherein the transfer ply is applied to the substrate by means of a thermoplastic toner in a roll arrangement having a press nip of 5 mm to 20 mm.

40. The method as claimed in claim 1, wherein the transfer ply is applied to a three-dimensional, domed, curved, cylindrical or flat substrate.

41. The method as claimed in claim 40, wherein the transfer ply is applied using a pressing apparatus which is transparent for a wavelength used for the precuring and/or full curing of the adhesive.

42. The method as claimed in claim 41, wherein the substrate, during the application of the transfer ply, is mounted rigidly or rotatably on a holding means which is transparent for a wavelength used for the precuring and/or full curing of the adhesive.

43. The method as claimed in claim 41, wherein the adhesive is precured or fully cured by irradiating it using a light source disposed within the pressing apparatus and or a light source disposed on the side of the pressing apparatus that faces away from the holding means.

44. The method as claimed in claim 42, wherein the pressing apparatus or the holding means has a pressing layer which is formed of one or more silicone plies and has a thickness in the range from 1 mm to 20 mm, and a hardness of 20° Shore A to 70° Shore A, and a surface roughness (mean roughness value) of below 0.5 μm.

45. The method as claimed in claim 44, wherein the pressing layer has a surface structure, in the form of a pattern or decoration.

46. The method as claimed in claim 40, wherein the transfer ply is applied with an applied force of 1 N to 1000 N.

47. The method as claimed in claim 2, wherein the first positional datum comprises a position or extent of the transfer ply remaining on the carrier ply.

48. A method for applying a transfer ply of a foil to a substrate comprising:

a) transporting the foil to the substrate with a foil transport apparatus;

b) applying a thermoplastic toner to at least one subregion of the substrate and/or to at least one subregion of the transfer ply of the foil;

c) applying the transfer ply to the substrate by means of a stamping apparatus;

d) causing an applied pressure and heat to act on the transfer ply and/or the substrate;

e) peeling a carrier ply of the foil, to leave at least one first subregion of the transfer ply on an application region of the substrate, and at least one second subregion of the transfer ply on the carrier ply;

f) winding up or recoiling the carrier ply with the remaining second subregion of the transfer ply; and g) applying at least one further subregion of the transfer ply remaining on the carrier ply to the substrate by at least once repeating steps a) to f), wherein the foil transport apparatus sets extension of the foil to a value of 1% to 6%, and wherein, to set a defined relative position between the foil and the substrate or between the foil and the inkjet printhead, the foil transport apparatus varies the extension of the foil on the basis of at least one positional data value.

* * * * *